US005106219A

United States Patent [19]

Wyhof

[11] Patent Number: 5,106,219

[45] Date of Patent: Apr. 21, 1992

[54] COLLAPSIBLE PRINTER CASE

[75] Inventor: John R. Wyhof, Santa Rosa, Calif.

[73] Assignee: Alps Electric (USA), Inc., San Jose, Calif.

[21] Appl. No.: 591,576

[22] Filed: Oct. 2, 1990

[51] Int. Cl.[5] ..... B41J 11/56

[52] U.S. Cl. ..... 400/680; 346/145; 400/650; 400/693

[58] Field of Search ..... 400/680, 691, 693, 88, 400/552, 358, 650, 651, 657, 682, 683, 684, 685; 346/145

[56] References Cited

U.S. PATENT DOCUMENTS

| | | | |
|---|---|---|---|
| 1,281,102 | 10/1918 | Tucker | 400/691 X |
| 1,283,367 | 10/1918 | Tucker | 400/358 X |
| 1,455,201 | 5/1923 | Hess | 400/657 |
| 1,496,404 | 6/1924 | Barney | 400/650 |
| 2,418,785 | 4/1947 | Mills | 400/682 X |
| 2,804,188 | 8/1957 | Brace | 400/691 X |
| 3,638,776 | 2/1972 | Ridge | 400/680 |
| 3,711,175 | 1/1973 | Sottsass | 312/208 |
| 3,830,352 | 8/1974 | Kolpek | 400/682 |
| 3,900,098 | 8/1975 | Effinger | 400/552 |
| 4,586,838 | 5/1986 | Hara | 400/693 X |

FOREIGN PATENT DOCUMENTS

| | | |
|---|---|---|
| 238739 | 2/1965 | Austria . |
| 494009 | 2/1930 | Fed. Rep. of Germany . |

*Primary Examiner*—Edgar S. Burr
*Assistant Examiner*—Moshe I. Cohen
*Attorney, Agent, or Firm*—Guy W. Shoup; David W. Heid; Patrick T. Bever

[57] ABSTRACT

A lightweight collapsible printer case for use with portable computers having two telescoping case sections, the case containing a series of telescoping roller shafts, a metal tape platen and carriage tracks which are housed within a tape reel, and a reel mechanism for coiling a carriage positioning cable. The collapsible printer case can be expanded from a collapsed travel/storage mode to an operational mode. In the operational mode the printer can print characters or graphics onto a standard 8.5" width sheet of paper or other media.

13 Claims, 13 Drawing Sheets

COLLAPSIBLE PRINTER CASE

BACKGROUND OF THE INVENTION

1. Field of Invention

This invention relates to printers for computers, and more particularly to compact, lightweight printers for use with portable computers.

2. Description of the Prior Art

The increased use of portable computers has created a need for compact, lightweight portable printers which can be conveniently carried by a computer operator. Two examples of prior art portable printers are the Diconix 150 and the Toshiba Expresswriter 301. Each of these printers is lightweight (approximately 4 lbs.) and each can print on a standard 8.5"×11", letter size, or 8.5"×14" sheet, legal size sheet of plain paper. However, although typically much smaller than standard desk-top printers, prior art portable printers continue to be undesirably large.

The undesirable size of the prior art portable printers accomodating 8.5" wide standard paper is mainly attributable to the cylindrical paper feed roller used to move a sheet of paper through the printer. The prior art paper feed roller is a solid, rubber-coated shaft approximately 11 to 12 inches in length. This paper feed roller is incorporated within the casing of the prior art portable printers. Therefore, the miniaturization of casings for prior art portable printers is limited by the paper feed roller to a length of approximately one foot.

It is therefore an objective of this invention to provide a portable printer case whose length during storage or transportation is substantially less than the length of the prior art portable or desk-top printers, but whose length while printing is capable of handling standard width-size sheets of paper. This objective requires that the length of the paper feed rollers within the printer case be adjustable between a shortened "storage/travel mode" and a full-length "operational mode".

One method of providing an adjustable paper feed roller is suggested in Tucker, U.S. Pat. No. 1,283,367. Tucker discloses a typewriting machine whose length can be expanded or contracted by the addition or subtraction of detachable sections of the paper feed roller, thereby accomodating different widths of paper. These detachable sections are screwed on or off of a main section of the paper feed roller. The adjustable paper feed roller is adapted to the typewriting machine by expanding or contracting an extensible carriage which reciprocates in front of a stationary typing head. The carriage is disposed to reciprocate outside of the main typewriting machine casing; therefore, the length of the adjustable paper feed roller is limited only by the adjustable parameters of the carriage.

The method for expanding a paper feed roller taught by Tucker is not easily incorporated into a modern portable printer case. First, the use of detachable sections of paper feed roller require the operator to carry the detachable sections with the printer and assemble the printer before each use. Moreover, because the assembled paper feed roller is solid, there is no reduction in cumulative weight from the portable printers discussed above. Finally, Tucker's expandable feed roller is incorporated into a manual typewriter and adjustments for incorporating the feed roller are limited to the reciprocating extensible carriage. Modern printers incorporate fixed paper feed rollers and a reciprocating printer head mounted on a carriage, all contained within a single case. Therefore, the use of Tucker's expandable feed roller would require redesigning the printer head carriage as well as the printer case to incorporate the stationary-head, reciprocating-roller features.

SUMMARY OF THE INVENTION

Therefore, it is an objective of this invention to provide a printer case which can be collapsed and expanded along its length. In addition, it is an objective to provide a collapsible printer case housing a collapsible paper feed roller which does not require the addition/subtraction of detachable sections. It is also an objective to provide a printer case for housing a printer in which the internal components of the printer adjust between an expanded "operational mode", and a collapsed "travel/storage" mode.

In response to the problems associated with the prior art compact printers, this invention introduces a collapsible printer case made up of two or more printer case sections, one printer case section capable of sliding within the other printer case section. Contained within the printer case are printer elements adapted to allow the collapsible printer case to adjust between the collapsed travel/storage mode and an expanded operational mode. The printer elements include a series of telescoping roller shafts which can be contracted and expanded along their length, thereby being adjustable to the mode of the collapsible printer case. In addition, the collapsible printer case contains a metal tape platen and carriage tracks housed within a tape reel when the collapsible printer case is in the storage/travel mode. Moreover, the collapsible printer case contains a reel mechanism for coiling the slack portion of a carriage positioning cable when the printer case is in the travel/storage mode.

DETAILED DESCRIPTION OF THE PREFERRED EMBODIMENT

A collapsible printer case 1 is comprised of a first, or smaller, case half (section) 2 and a second, or larger, case half (section) 3, both preferably made of hard molded plastic or extruded plastic with molded plastic end plates.

Figure 3:
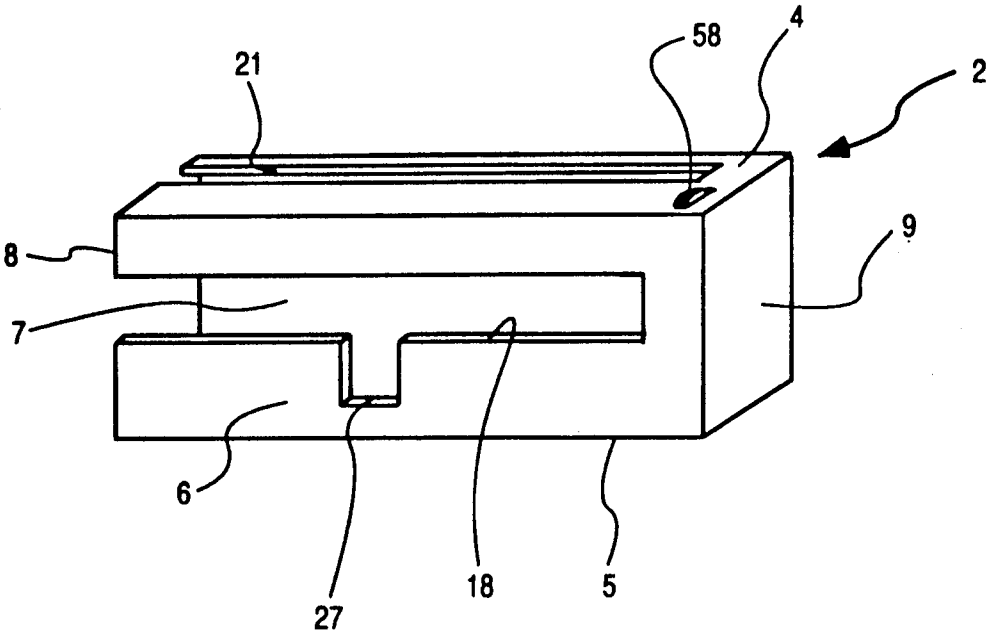
FIG. 3 is a perspective view of the larger case section.

As shown in FIG. 3, the smaller case half 2 has the shape of a rectangular box with opposing front and back planes 6, 7, opposing top and bottom planes 4, 5, and an open side 8 opposing a closed side plane 9. Each plane has an inside surface and an outside surface on the inside and outside of the smaller case half 2, respectively. The distance between the outside surface of the bottom plane 4 and the outside surface of the top plane 5 defines the height of the smaller case half 2. Similarly, the distance between the outside surface of the front plane 6 and outside surface of the back plane 7 define the width of the smaller case half 2. Finally, the distance between the edge defining the open side 8 and the outside surface of the closed side plane 9 define the length of the smaller case half 2.

Figure 4:
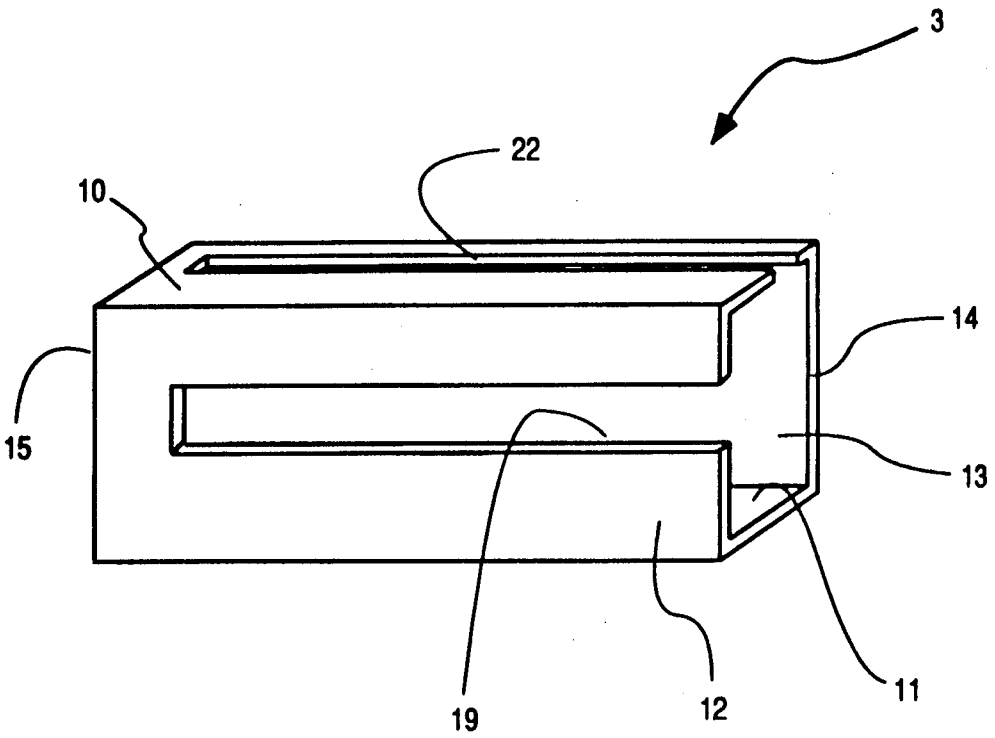
FIG. 4 is a perspective view of the smaller case section.

As shown in FIG. 4, the larger case half 3 has a rectangular shape similar to the smaller case half 2; however, the width and height of the larger case half 3 are slightly greater. Because the smaller case half 2 fits within the larger case half 3 when the collapsible printer case 1 is assembled, the distance between the inside surface of the top and bottom planes 10, 11 of the larger case half 3 is slightly greater than the height of the smaller case half 2. In addition, the distance between the inside surface of the front and back planes 12, 13 of the larger case half 3 is slightly greater than the width of the smaller case half 2. With these dimensions, the smaller case half 2 can be inserted and slide within the larger case half 3. The length of the larger case half 3 is the distance between the edge defining the open side 14 and the outside of the closed side plane 15.

When the collapsible printer case 1 is assembled, the open side 8 of the smaller case half 2 and open side 14 of the larger case half 3 are brought together such that when the smaller case half 2 is slid within the larger case half 3, a rectangular collapsible printer case 1 is formed having no completely open sides. Once assembled, the collapsible printer case 1 can be adjusted between two positions: a travel/storage mode and an operational mode.

Figure 2:
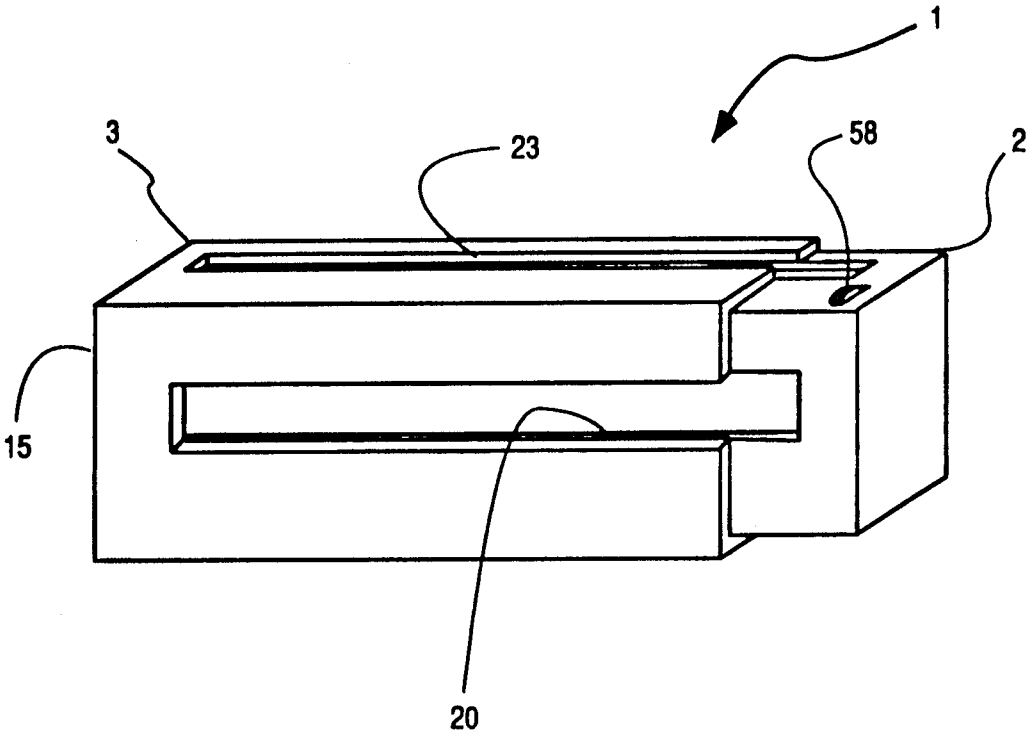
FIG. 2 is a perspective view of the assembled collapsible printer case in the travel/storage mode.

As shown in FIG. 2, the travel/storage mode is achieved when the smaller case half 2 slides within the larger case half 3 until the edge defining the open end 8 of the smaller case half 2 is adjacent the inside surface of the closed side plane 15 of the larger case half 3. In the travel/storage mode the collapsible printer case 1 has a size of approximately 2"×3"×6".

Figure 1:
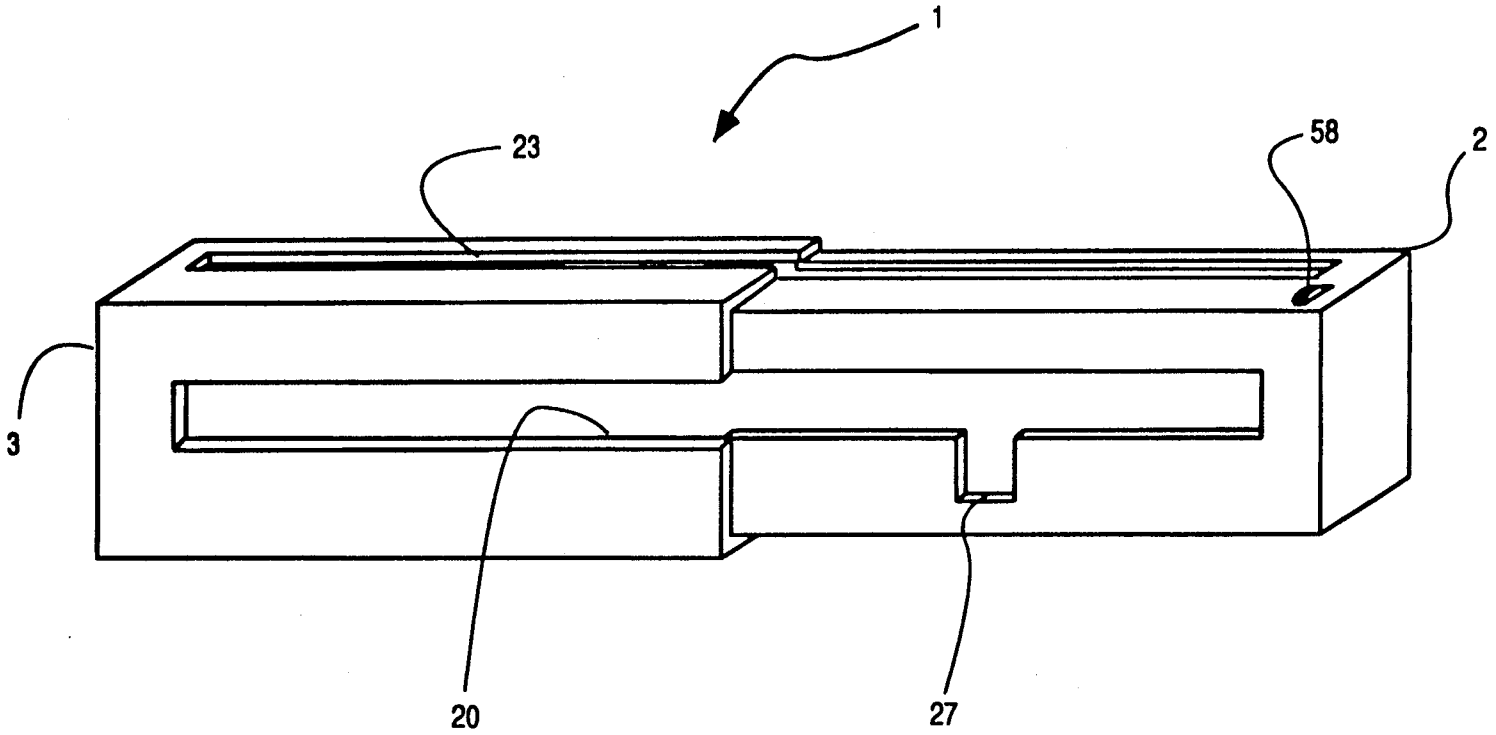
FIG. 1 is a perspective view of the assembled collapsible printer case in the operational mode.

The operational mode is shown in FIG. 1. To alter the collapsible printer case 1 from the travel/storage mode to the operational mode, the edge defining the open side 8 of the smaller case half 2 is moved away from the inside surface of the closed side plane 15 of the larger case half 3. Before the smaller case half 2 is fully separated from the larger case half 3, the movement of the smaller case half 2 is impeded by full extension of the internal components (discussed below) of the collapsible printer case 1. When the smaller case half 2 has been moved to the point at which the internal components of the collapsible printer case 1 have fully extended, the collapsible printer case 1 is in the operational mode. A locking mechanism may be used to secure the collapsible printer case 1 in the operational mode and/or the storage/travel mode. When the collapsible printer case 1 is in the operational mode, it is capable of receiving, positioning for printing, and expelling a sheet of paper or other media having a width of 8.5" or less. In the operational mode the collapsible printer case 1 has a size of approximately 2"×3"×12". Note that the length (approximately 12") of the collapsible printer case 1 in the operational mode is the sum of the length of the smaller case half 2 and the larger case half 3, minus a small overlap distance.

Disposed on a front plane 6 of the smaller case half 2 is a long opening 18 extending from the edge of the open side 8 to a point adjacent the edge of the closed side plane 9. A long opening 19 is similarly disposed on the front plane 12 of the larger case half 3. The openings 18, 19 on the smaller and larger case halves are orientated such that when the collapsible printer case 1 is in the operating mode, the openings 18, 19 form a continuous opening through which a piece of paper can be inserted within the printer case. This continuous opening is shown as a paper input slit 20 (see FIGS. 1 and 2).

Similarly, disposed on the top planes 5, 10 of both the smaller and larger case halves are long openings 21, 22 forming a paper output slit 23.

Figure 5:
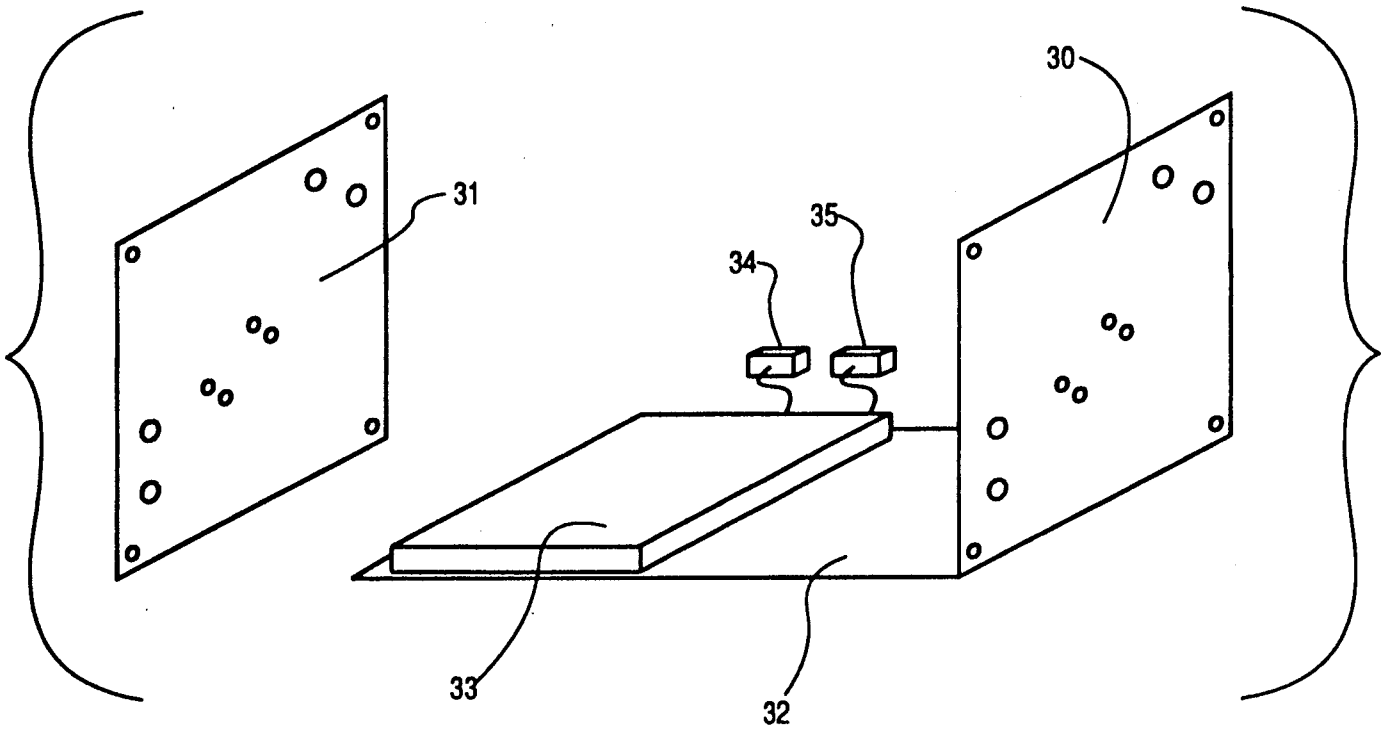
FIG. 5 is a perspective view showing the relational positions of the end plates and base plate.

As indicated in FIG. 5, a first, or smaller, end plate 30 is, for example, cut from sheetmetal and shaped to fit against the inside surface of the closed side plane 9 of the smaller case half 2. Similarly, a second, or larger, end plate 31, is shaped to fit against the inside surface of the closed side plane 15 of the larger case half 3. Thus, when the larger and smaller end plates are placed within the assembled collapsible printer case 1, the plates form two parallel planes, separated by the distance between the closed side planes of the smaller and larger case halves. Thus, the distance between the end plates depends upon the mode of the case; i.e., when the case is in the operational mode, the end plates are approximately 12" apart and when the case is in the travel/storage mode, the end plates are approximately 6" apart.

Attached at a right angle to the smaller end plate 2 is a base plate 32. The base plate 32 is approximately the size and shape of the inside surface of the bottom plane 4 of the smaller case half 2.

Attached to the base plate 32 is a printer controller board 33. The printer controller board 33 is operably connected to a power input terminal 34 and a signal input terminal 35. Output from the printer controller board 33 is transferred by cable to the various elements of the printer (to be discussed later). The output from the printer controller board 33 coordinates the operations of the various elements of the printer.

The power input terminal 34 and the signal input terminal 35 are located such that they can be accessed from the exterior of the case for connection with a power source and computer (not shown) when the collapsible printer case 1 is in the operational mode. A preferred location for the power and signal input terminals is on the back plane 7 of the smaller case half 2. In this embodiment, the terminals must be set flush with the outside surface of the back plane 7 of the smaller case half 2 so they do not interfere with the relative travel of the back plane 13 of the larger case half 3 as the collapsible printer case 1 is adjusted to the travel/storage mode.

Figure 6:
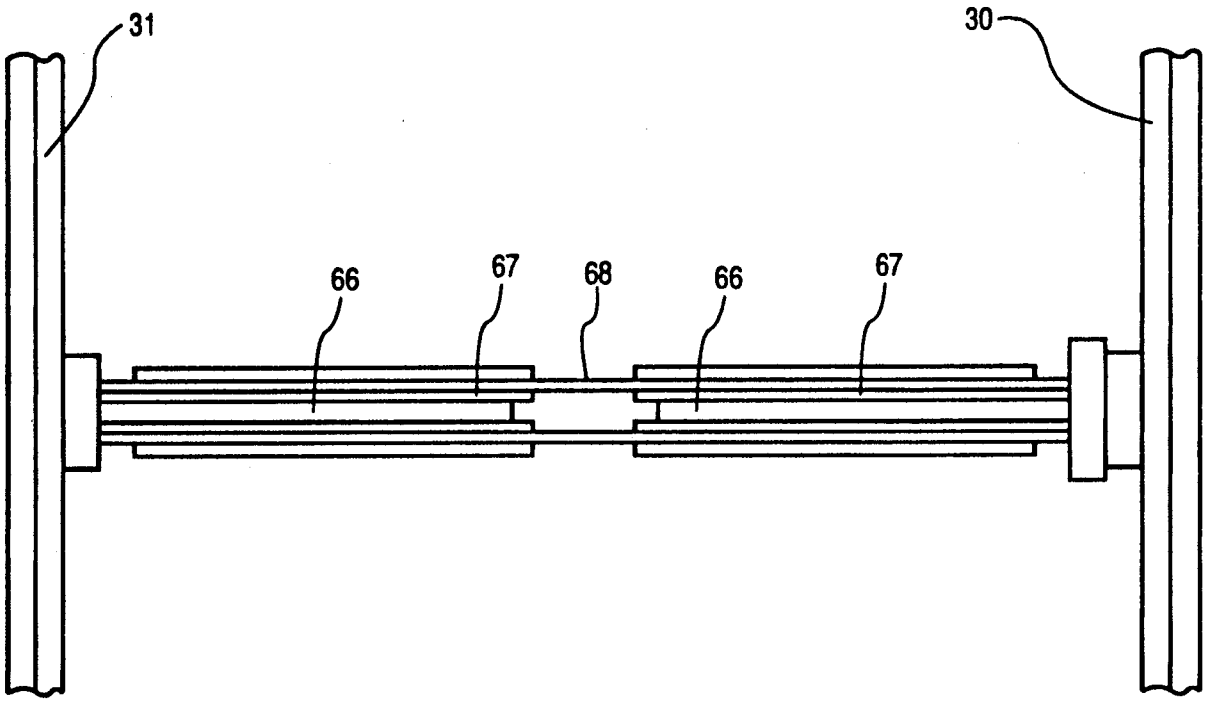
FIG. 6 is a sectional view of a roller shaft in the travel/storage mode.
Figure 7:
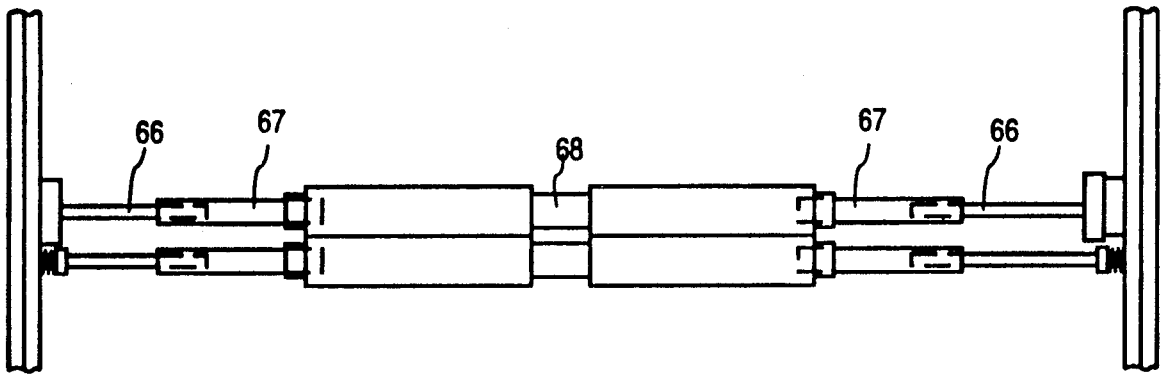
FIG. 7 is a sectional view of a roller shaft in the operational mode.

The internal components of the collapsible printer case 1 include four parallel roller shafts 41, 42, 43, 44 mounted between and connected to the smaller and larger end plates 30, 31 such that the roller shafts span the distance between the smaller and larger end plates. As shown in FIGS. 6 and 7, each roller shaft has five telescoping sections (two end rods 66, two intermediate tubes 67, and a central tube 68) and is capable of expanding and contracting along its length in a telescoping fashion. The two end rods 66 have the smallest diameter of the roller shaft sections. One end of each end rod 66 is attached to either a bearing or a pivot plate (discussed later). When the printer is in the operational mode, shown in FIG. 7, the opposite end of each end rod 66 is disposed within one end of an intermediate tube 67. When the printer is in the travel/storage mode, shown in FIG. 6, the intermediate tube 67 is disposed over each end rod 66. Finally, in the operational mode, one end of each intermediate tube 67 is inserted within one end of the central tube 68. In the travel/storage mode, the central tube 68 is disposed over the intermediate tube 67.

Figure 8:
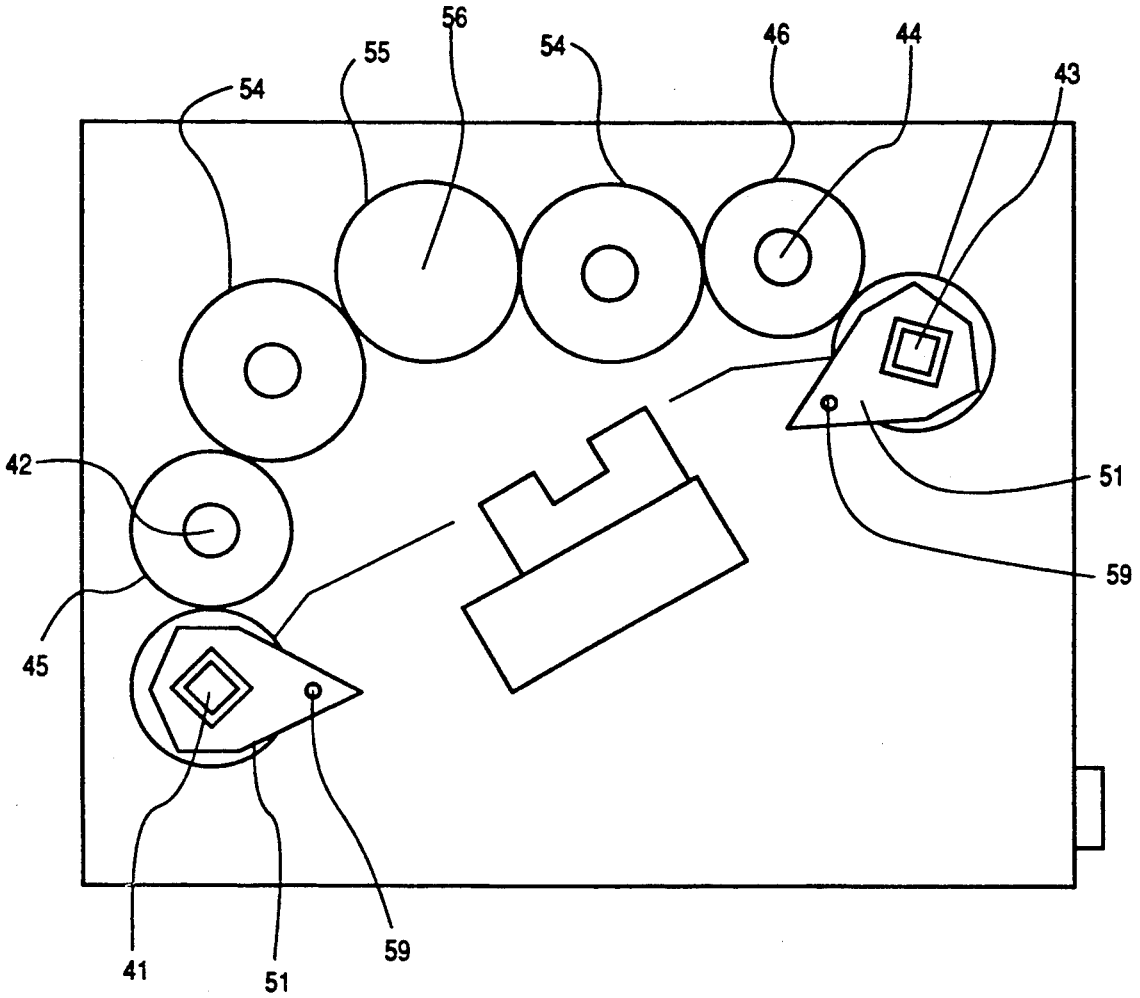
FIG. 8 is a sectional side view of the printer.
Figure 9:
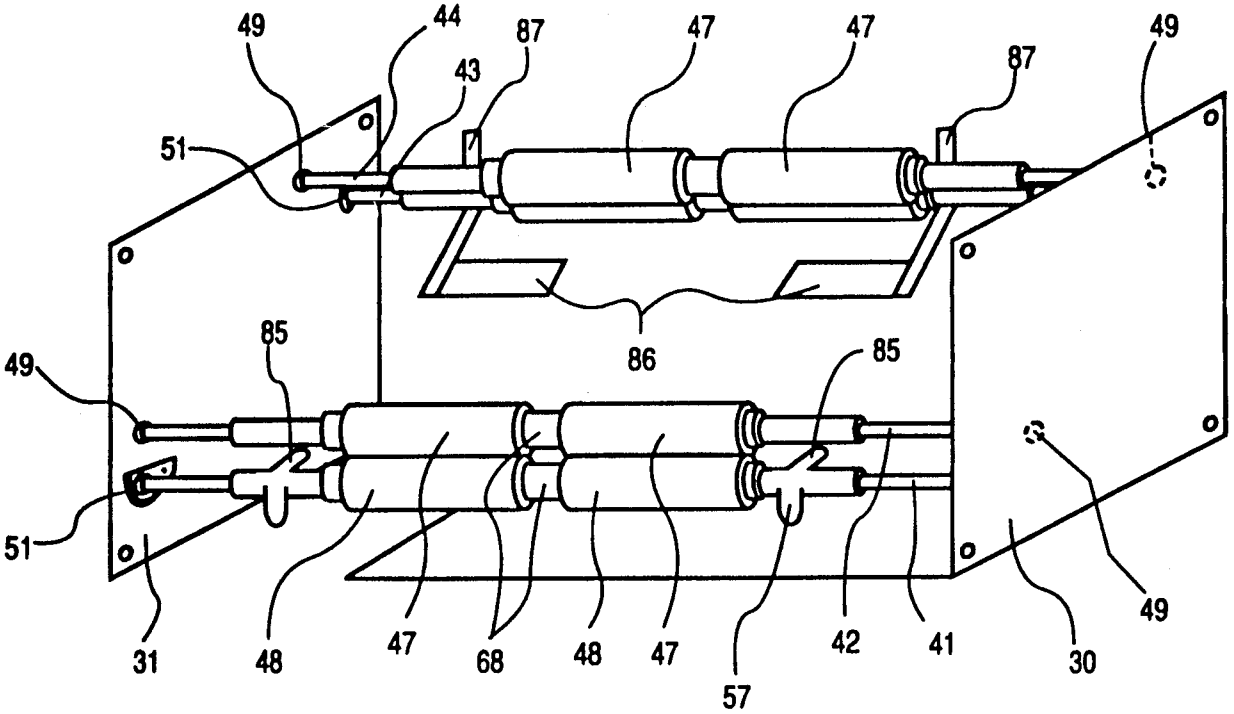
FIG. 9 is a perspective view showing the orientation of the roller shafts on the end plates.

As shown in FIGS. 8 and 9, the four roller shafts 41, 42, 43, 44 are mounted on the smaller and larger end plates 30, 31 in two pairs. A first pair of roller shaft 41, 42 is disposed adjacent the inside surface of the front planes 6, 12 of both the smaller and larger case halves 2, 3. These roller shafts are hereafter referred to as "input roller shafts". A second pair of roller shafts 43, 44 is disposed adjacent the inside surfaces of the top planes 5, 10 and back planes 7, 13 of the smaller and larger case halves. These roller shafts are hereafter referred to as "output rollers shafts".

The input roller shafts 41, 42 are arranged such that one roller shaft is a driven roller shaft 42 and one roller shaft is an idler roller shaft 41. The driven roller shaft 42 has a driven gear 45 near the end of the end rod 66 adjacent the smaller end plate 30. The output roller shafts 43, 44 are likewise arranged such that a driven gear 46 is mounted to the driven output roller shaft 44.

Mounted on the central tube 68 of each driven roller shaft is a pair of rubber rollers 47. Likewise, mounted on the central tube 68 of each idler roller shaft is a pair of rubber rollers 48. The rollers 47 of the driven roller shafts 42, 44 and the rollers 48 of the idler roller shafts 41, 43 are disposed such that when the roller shafts are telescoped into the operational mode, the rollers 47 on the driven input shafts 42, 44 oppose and abut the rollers 48 on the idler roller shafts 41, 43, respectively.

Each of the driven roller shafts 42, 44 is mounted on the smaller and larger end plates 30, 31 by means of roller bearings 49, thus allowing each of the shafts to rotate freely about its longitudinal axis. The roller bearings 49 are typical for printer roller shafts, with the exception that they account for a greater amount of thrust along the longitudinal axis due to the collapsing and expansion of the shafts as the collapsible printer case 1 is moved between the travel/storage mode and the operation mode. The amount of force to be taken into account when choosing a roller bearing 49 for thrust along the longitudinal axis will depend upon the design of the platen and carriage track tape reel and the carriage positioning mechanism (discussed below).

Figure 10:
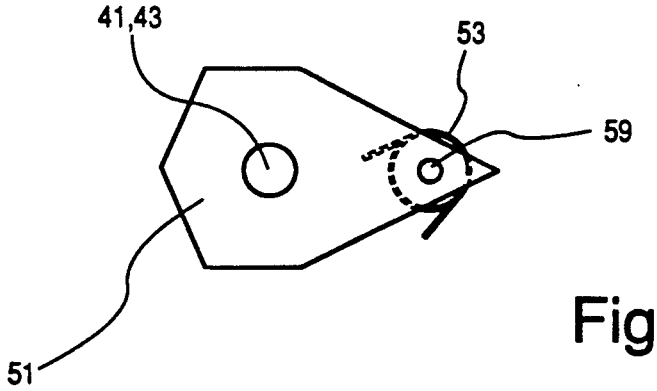
FIG. 10 is a plan view of a pivot plate.

Each of the idler roller shafts 41, 43 is mounted on a pair of pivot plates 51 which are in turn mounted to the smaller and larger end plates 30, 31 by means of a pivot pins 59 (as shown in FIGS. 8 and 10). Each of the pivot plates is arranged such that the idler roller shafts 41, 43 can be separated in a radial direction from the driven roller shafts 42, 44 thereby creating a space between the rollers 47, 48. The end rods 66 and the intermediate tubes 67 of each idler roller shafts 41, 43 do not rotate about a longitudinal axis. However, the central tube 68 of each idler roller shaft is connected to each intermediate shaft 67 by means of bearings allowing the central tube 68 to freely rotate about each intermediate shaft 67.

Each pivot plate 51, 52 is connected to a coil spring 53 which in turn is anchored to each end plate 30, 31 (as shown in FIG. 10). The function of the coil spring 53 is to bias the idler roller shafts 41, 43 to maintain contact between the rollers 47, 48 on the driven and idler roller shafts. This feature allows the rollers to adjust to the thickness of paper or other media upon which is printed a desired group of characters or graphic representation. In addition, this feature allows the operator to conveniently insert a sheet of paper or other media into the input slit.

In order for an operator to access and separate the input idler roller shaft 41 from the input driven roller shaft 42, a groove 27 (as shown in FIGS. 1 and 3) is defined by the front plane 6 of the smaller case half 2 on the edge defining the open side 8. Through the groove 27 the operator may access and manipulate a finger tab 57 (shown in FIG. 9) mounted on the input idler roller shaft 41 to separate the rollers 47 from the rollers 48 mounted on the input driven roller shaft 42.

As shown in FIG. 8, each of the gears 45, 46 of the driven roller shafts 42, 44 is meshed with an idler gear 54 rotatably mounted on the smaller end plate 30. Each idler gear 54 is in turn meshed with a single driving gear 55 operably attached to a driving motor 56. The driving motor 56 is mounted on the smaller end plate 30 and is connected to the printer controller board 33 by means of a fixed length of wire. The driving motor 56 must be capable of accommodating the described gear train. In addition, a thumb wheel 58 (shown in FIGS. 1-3) is disposed on the top plane 5 of the smaller case half 2 such that when the thumb wheel 58 is manipulated, the rotation is translated to the described gear train, thus allowing an operator to manually insert and expel a sheet of paper or other media. All of the above mentioned gears are typically made of hard plastic.

Figure 11:
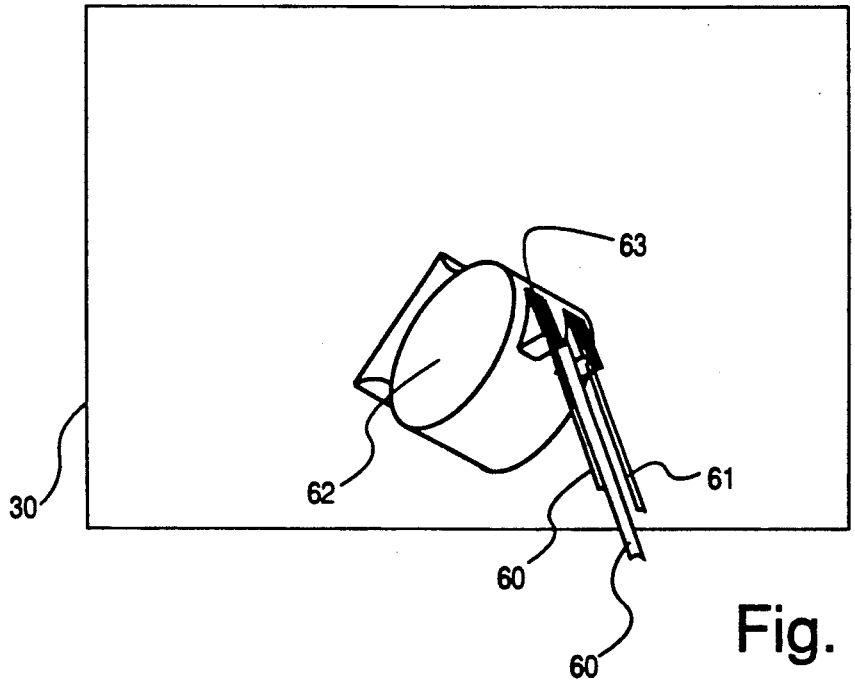
FIG. 11 is a perspective view of a tape reel.

A platen 60 and a pair of carriage tracks 61 are formed from metal or metal/plastic composite tape similar to a carpenter's tape measure. A tape reel 62 houses the platen 60 and carriage tracks 61 when the collapsible printer case 1 is in the travel/storage mode. The tape reel 62 operates like a carpenter's tape measure with the exception that the three metal tapes (one platen and two carriage tracks) are housed side by side within the tape reel 62, the platen 60 being positioned between the two carriage tracks 61. The tape reel 62 is connected to the smaller end plate 30 in an orientation similar to that suggested in FIG. 11. This orientation aligns the printer head relative to the paper such that the paper passes under the printer head 71 with as little change in direction as possible. The free ends of the platen and carriage tracks are secured to the larger end plate 31. The length of the platen and carriage tracks stored in the tape reel is such that they are pulled taut when the collapsible printer case 1 is expanded into the operational mode.

A spacer 63 (shown in FIG. 13) located on the outside of the tape reel 62 serves to orientate the platen 60 relative to the carriage tracks 61 during the printing operation. The exact orientation of the platen 60 to the carriage tracks 61 depends upon the design of the carriage (discussed later), which in turn depends upon the choice of print heads. Therefore, the orientation shown in FIG. 12 is merely suggestive.

As in a carpenter's tape measure, a coil spring (not shown) is disposed within the tape reel 62 and biases the platen and carriage tracks 61 such that they rewind within the tape reel 62. The coil spring should not be strong enough to impede the expansion of the collapsible printer case, but should be strong enough to draw the platen 60 and carriage tracks 61 into the tape reel 62 when the collapsible printer case is collapsed into the travel/storage mode. Note that the force exerted by the coil spring on the platen 60 and carriage tracks 61 is accounted for when choosing the roller bearings used to mount the driven roller shafts 42, 44 (discussed above).

Figure 12:
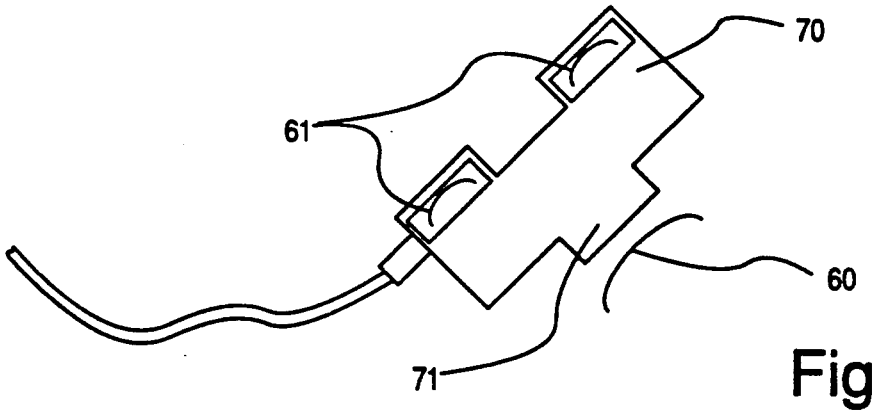
FIG. 12 is a partial sectional view showing a suggested method of mounting a carriage to a platen and carriage tracks.
Figure 13:
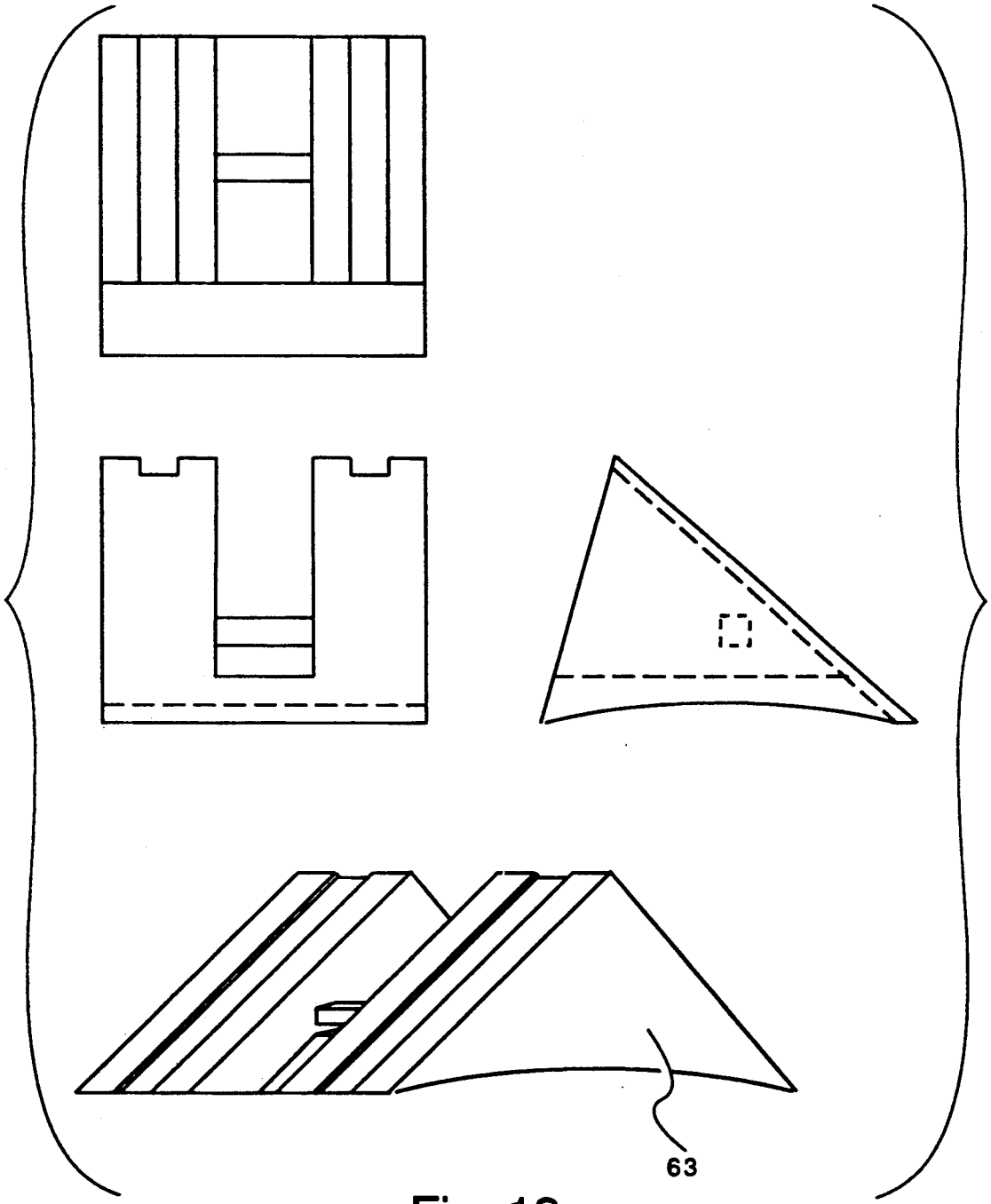
FIG. 13 is a perspective view of a spacer connected to a tape reel.
Figure 14:
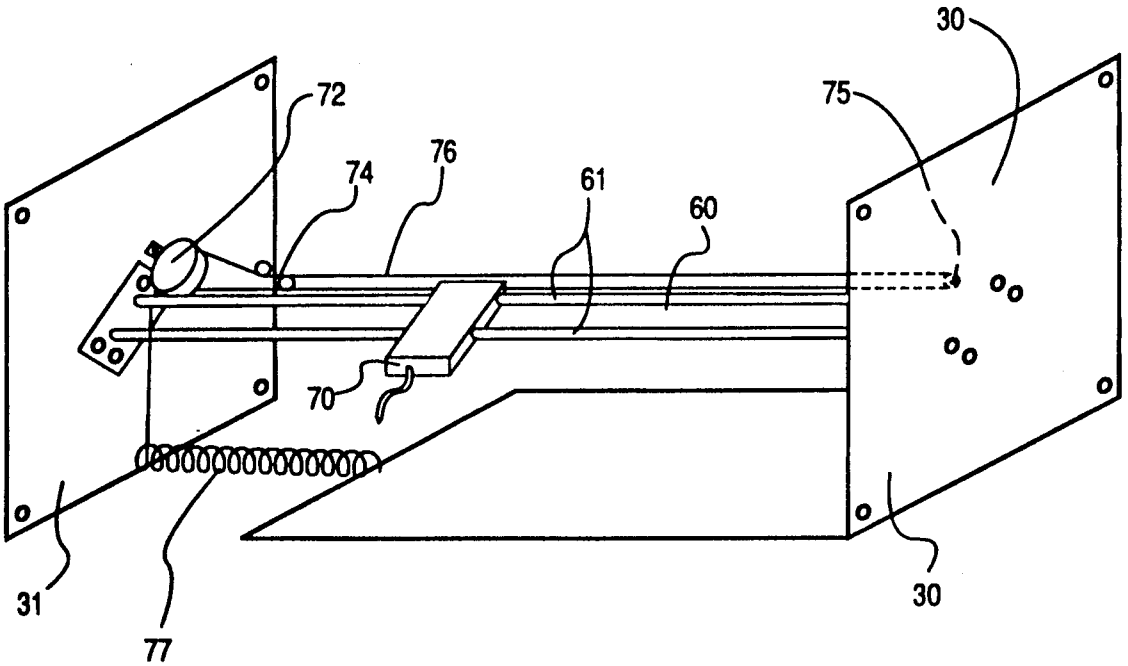
FIG. 14 is a perspective view showing the orientation of the carriage and positioning mechanism.

A carriage 70 is connected to the carriage tracks 61 by means of slides or rollers (shown in FIGS. 12 and 14). The carriage is moved along the carriage tracks by means of a carriage positioning mechanism (discussed below). The carriage carries a print head 71 which creates multiple dots forming characters or graphics onto a sheet of paper passing between the print head 71 and the platen 60 when the collapsible printer case 1 is in the operational mode.

A resilient coil cable 65 (or flexible ribbon tape) relays signals from the printer controller board 33 to the print head 71. One end of the resilient coil cable 65 is connected to the back of the carriage 70. A lead cable (not shown) leading from the controller board 33 to the resilient coil cable 65 is connected to the smaller end plate 30 and is lead along the inside surface of the top plane 5 of the smaller case half 2. The lead cable and the resilient coil cable 65 connect at a point near the edge defining the open side 16 of the smaller case half 2. With this arrangement, when the collapsible printer case 1 is in the operational mode, the connection between the printer controller board 33 and the resilient coil cable 65 is centrally located with respect to the carriage 70 as it reciprocates along the carriage tracks 61. The resilient coil cable 65 should be resilient enough to remain relatively taut, yet the spring force should not be great enough to impede the carriage 70 as it travels on the carriage tracks 61.

A print head 71 is mounted on the carriage 70 to print characters or graphics onto a sheet of paper or other media fed into the collapsible printer case 1. The print head 71 can be of one of several types; no particular type of print head is preferred because each presents its own advantages and disadvantages. For example, a thermal transfer print head provides excellent print quality, but would require a small ink ribbon cassette in order to avoid impeding the movement of the carriage. Because the size of this ink ribbon cassette would be small, the printer would have a limited printing capability before the cassette would need replacing. An ink jet print head would obviate the need for an ink ribbon, but would require the design of an easily accessible and sufficiently voluminous ink reservoir. Other types of print heads have similar advantages and disadvantages.

Figure 15A:
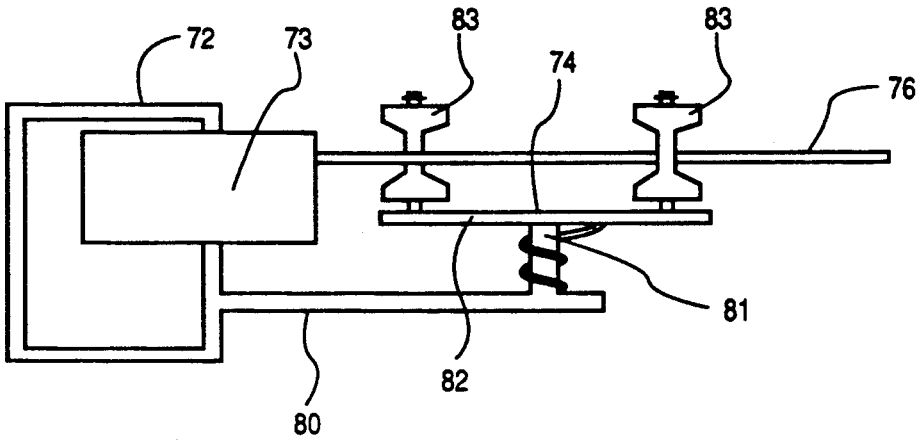
FIGS. 15*a* and 15*b* are front top views of a reel mechanism for the positioning mechanism.

A carriage positioning mechanism 72 (shown in FIGS. 14 and 15) is provided to position the carriage 70, and thus the print head 71, over the paper during the printing process. The carriage positioning mechanism 72 is made up of a carriage positioning motor 73 attached to the larger end plate 31, a reel mechanism 74 also connected to the larger end plate, a pulley 75 connected to the smaller end plate 30, and a positioning cable 76. Both ends of the positioning cable 76 are connected to the carriage 70. The remainder of the positioning cable 76 is looped around the carriage positioning motor 73, pulley 75 and reel mechanism 74. The carriage positioning motor 73 and pulley 75 provide the necessary tension along the positioning cable 76 to position the carriage 70 for printing when the collapsible printer case is in the operational mode.

The power and control signals for the carriage positioning motor 73 are sent from the printer controller board 33 by means of a resilient cable 77 similar to the cable 65 connecting the printer head 71 and the printer controller board 33. One end of the cable 77 is secured to the carriage positioning motor 73 and larger end plate 31. The other end of the cable 77 is connected to the printer controller board 33 adjacent the open side 8 of the smaller case half 2.

Figure 15B:
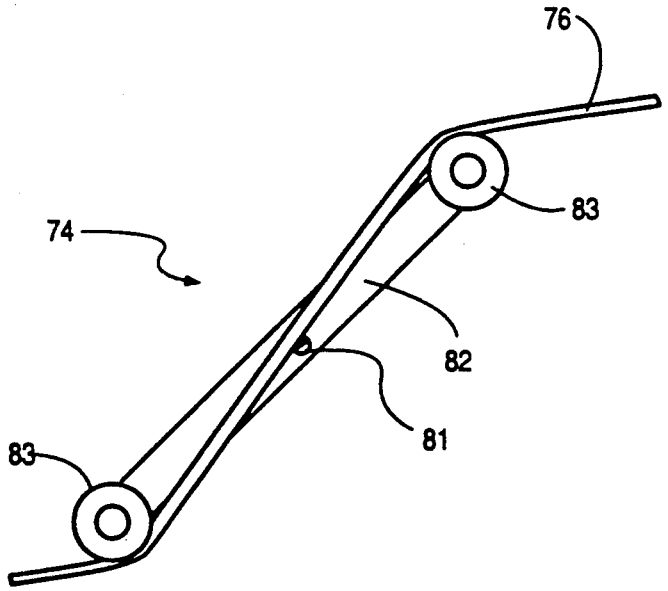

The reel mechanism 74 (shown in FIGS. 14 and 15) of the carriage positioning mechanism 72 serves to wind up and store the slack portion of the positioning cable 76 when the collapsible printer case 1 is collapsed into the travel/storage mode. The reel mechanism 74 is composed of a bracket 80 connecting the reel mechanism 74 to the larger end plate 31, a pivot 81 connected to the bracket 80, and a shoulder 82 rotatably mounted on the pivot 81. Attached at each end of the shoulder 82 are rollers 83 over which the positioning cable 76 is trained as shown in FIG. 15*b*. A coil spring 84 is attached to the pivot 81 which biases the shoulder 82 to rotate in a counter-clockwise direction (with respect to FIG. 15*b*).

Mounted onto the input and output idler roller shafts 41, 43 between the rollers 48 is a series of pawls 85, 86, 87, as shown in FIG. 9. The pawls are used to direct the leading edge of the sheet of paper or other media as it travels the collapsible printer case 1. More specifically, pawls 85 mounted on the input idler roller shaft 41 are positioned such that after the leading edge of the paper passes between the input rollers 47, 48, it is directed to the point between the print head 71 and the platen 60. A first, or lower, series of pawls 86 mounted on the output idler roller shaft 43 direct the leading edge of the paper to the point between the output rollers 47, 48. A second, or upper, series of pawls 87 mounted on the output idler roller shaft 43 direct the leading edge of the paper through the output slit 23 and out of the collapsible printer case 1.

Assembly of the collapsible printer case 1 will now be described. The printer controller board 33 is first fixed to the base plate 32. Roller shafts 41, 42, 43, 44 are then attached to the smaller end plate 2 and larger end plate 3, thereby providing a substantially rigid frame upon which to mount all other components. Once the components are mounted, the smaller case half 2 is fitted over the smaller end plate 30 and the power and signal input terminals 25, 26 are installed. The smaller end plate 30 is then fastened to the smaller case half 2. Finally, the larger case half 3 is fitted over the larger end plate 31 and fastened.

The operation of the collapsible printer case 1 will now be described. First, the collapsible printer case 1 is expanded from the travel/storage mode to the operational mode. Wires connecting the power input terminal 34 to the portable computer or a separate power source and signal input terminal 35 to the portable computer are then connected. An operator then presses the finger tab 57, thereby separating the rollers 47 on the input idler roller shaft 41 from the rollers 48 on the input driven roller shaft 42. The operator then inserts a sheet of paper between the rollers and releases the finger tab. The operator then positions the leading edge of the sheet of paper in front of the print head 71 by means of the thumb wheel 58. A signal from a computer is then sent via the signal input terminal 26 to the printer controller board 33, thus initiating the printing process.

Once the printing process is completed, printer controller board 33 positions the carriage adjacent the larger end plate 31. Then, the operator removes the wires connecting the power input terminal 25 and signal input terminal 26. Finally, the collapsible printer case is collapsed into the travel/storage mode.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover the appended claims and such modifications as fall within the scope of the claims.

I claim:

1. A printer case comprising at least two telescoping case sections operably connected to form said printer case, said case sections housing at least one shaft having a longitudinal axis, said at least one shaft being collapsible along the longitudinal axis, said case sections capable of sliding one within the other in a direction substantially parallel to the longitudinal axis of said at least one shaft, thereby allowing said printer case to adjust between a smaller travel/storage mode and a larger operational mode.

2. The printer case of claim 1 wherein said printer case comprises a first housing section having a first paper entry slot extending from a side edge of said first housing section, and a second housing section having a second paper entry slot extending from a side edge of said second housing section facing and longitudinally aligned with said first slot wherein said first and second housing sections are telescopably movable together to said travel/storage mode such that said entry slots substantially coincide and wherein said first and second housing sections are moved telescopably outward such that said slots form essentially a double width single entry slot for reception of a width of printer paper.

3. The printer of claim 2 wherein said first housing section has a first paper exit slot extending parallel to and substantially coextensive with said first paper entry slot; and said second housing section has a second paper exit slot extending parallel to and substantially coextensive with said second paper entry slot, said exit slots being in alignment longitudinally and forming in an operational mode essentially a double width exit slot for exiting of a width of printer paper.

4. The printer of claim 3 wherein said second housing section includes a reduced cross-sectional portion containing said entry and exit slots and an end portion having a cross-section essentially the same as the cross-section of said first housing section wherein said second housing section is telescopable into said first housing section to collapse said printer in said travel/storage mode.

5. The printer of claim 1 wherein said housing sections in said operational mode extend over a case length of from about 11.5 inches to about 13 inches and in said travel/storage mode extend over a case length of from about 5.75 inches to about 6.5 inches.

6. In a case for a printer including:

an elongated platen disposed within said case between two opposing sides of said case;

a pair of carriage tracks disposed substantially parallel and adjacent said platen;

a carriage slidably mounted on said carriage tracks;

a print head mounted on said carriage and disposed to perform a printing operation on printing media located between said platen and said print head;

a positioning cable connected to said print head and a motor, said positioning cable capable of positioning said carriage along said carriage tracks such that said print head is positioned in front of a desired location on the printing media;

the improvement comprising:

said printer case being an assembly of at least two housing sections telescopable with respect to each other such that said printer case is collapsible from an expanded operational to a collapsed travel/storage mode;

means for storing said carriage tracks and said platen when said printer case is in said travel/storage mode;

means for transporting printing media from a source outside of said printer case to a point between said platen and the print head, and for ejecting said printing media from said printer case, said transporting means collapsible to fit within said printer case when said printer case is in said travel/storage mode; and means for storing said positioning cable when said printer case is in said travel/storage mode.

7. The printer case of claim 6 wherein said means for storing said carriage tracks and said platen when said printer case is in said travel/storage mode comprises means operably connecting one end of said carriage tracks and said platen to a reel mechanism such that a portion of said carriage tracks and said platen is wound and housed within a reel mechanism when said printer case is collapsed to said travel/storage mode.

8. The printer case of claim 7 wherein said platen and said carriage tracks comprise metal or composite tapes.

9. The printer case of claim 6 wherein said print media transporting means comprises a series of telescoping roller shafts disposed to collapse when said printer case is in said travel/storage mode.

10. The printer case of claim 9 wherein said series of telescoping roller shafts comprises at least one driven roller shaft, operably connected to a driving source such that said driven roller rotates at a desired rate to position said print media between said platen and said print head, and at least one idler roller shaft parallel to and adjacent to said driven roller shaft.

11. The printer case of claim 10 wherein said series of telescoping roller shafts comprise two driven roller shafts and two idler shafts:

one driven roller shaft and one idler roller shaft acting as an input roller shaft pair such that said input pair pulls into the printer case printing media from a source outside of said printer case; and the other driven roller shaft and idler roller shaft acting as an output roller shaft pair such that said output pair expells printing media from the printer case.

12. The printer case of claim 11 wherein a series of pawls are mounted to said idler roller shafts to form a paper path along which said printing media is directed when said printing media is transported through said printer case.

13. The printer case of claim 6 wherein said means for storing said positioning cable is a reel mechanism comprising:

a bracket connected to one side of said printer case;

a shoulder rotatably mounted on said bracket;

a coil spring connected at one end to said bracket and at the other end to said shoulder, thereby causing said shoulder to be biased in one rotational direction;

at least two rollers mounted on opposite ends of said shoulder; wherein said positioning cable is trained over said rollers such that when said printer case is in said travel/storage mode, said coil spring causes said reel mechanism to coil said positioning cable around said rollers by rotating said shoulder on said bracket.

* * * * *